US006578338B1

(12) United States Patent
Nanayakkara

(10) Patent No.: US 6,578,338 B1
(45) Date of Patent: Jun. 17, 2003

(54) CONSTRUCTIONAL BRICK

(76) Inventor: Lakdas Nanayakkara, 2211 NE. 54th St., Fort Lauderdale, FL (US) 33308

( * ) Notice: Subject to any disclaimer, the term of this patent is extended or adjusted under 35 U.S.C. 154(b) by 0 days.

(21) Appl. No.: 09/546,918

(22) Filed: Apr. 11, 2000

Related U.S. Application Data

(63) Continuation-in-part of application No. 08/924,517, filed on Sep. 5, 1997, now Pat. No. 6,105,330.
(60) Provisional application No. 60/128,789, filed on Apr. 12, 1999.

(51) Int. Cl.[7] ..... E04B 5/04
(52) U.S. Cl. ..... 52/606; 52/604; 52/603
(58) Field of Search ..... 52/604, 606, 98, 52/506.02, 300, 603; 425/352

(56) References Cited

U.S. PATENT DOCUMENTS 868,838 A * 10/1907 Brewington
1,242,087 A * 10/1917 Waddell
4,787,189 A * 11/1988 Haug et al. ..... 52/415
5,531,586 A * 7/1996 Hyde ..... 425/352
5,676,540 A * 10/1997 Williams et al. ..... 432/247
5,899,040 A * 5/1999 Cerrato ..... 52/604
5,930,958 A * 8/1999 Stanley ..... 52/98
5,934,035 A * 8/1999 Rasmussen et al. ..... 52/300
5,966,886 A * 10/1999 Di Loreto ..... 52/506.02

* cited by examiner

*Primary Examiner*—Carl D. Friedman
*Assistant Examiner*—Basil Katcheves
(74) *Attorney, Agent, or Firm*—M. K. Silverman

(57) ABSTRACT

A constructional brick, for use in the forming of a wall structure capable of resisting high gravity and lateral loads of both a uniform and cyclical character, exhibits a generally solid rectangular exterior configuration defining an xyz Cartesian coordinate system, an x-axis capable of defining a width axis of the wall structure, a y-axis defining the directionality of the wall structure, and a z-axis defining a vertical axis of the wall structure. One xz end surface of each building block displays a positive y-axis deep key geometry and each opposing xz end surface thereof comprises a negative y-axis deep key geometry complementally interlockable to the positive geometry of the opposite xz surface, in which y-axis deep key dimensions of the respective positive and negative deep key geometries exist in a range of about 10 to about 50 percent of the x-axis dimension of the brick, in which an upper xy surface of the brick includes a number of z-axis recesses, each having an xy plane lower surface, and a lower xy surface of the brick including a corresponding number of integral z-axis male members complementary interlockable with the z-axis recesses. Use of such bricks provides a substantially rigid and load-resistant interlock between horizontally and vertically contiguous bricks, when joined together as components of a wall structure.

2 Claims, 10 Drawing Sheets

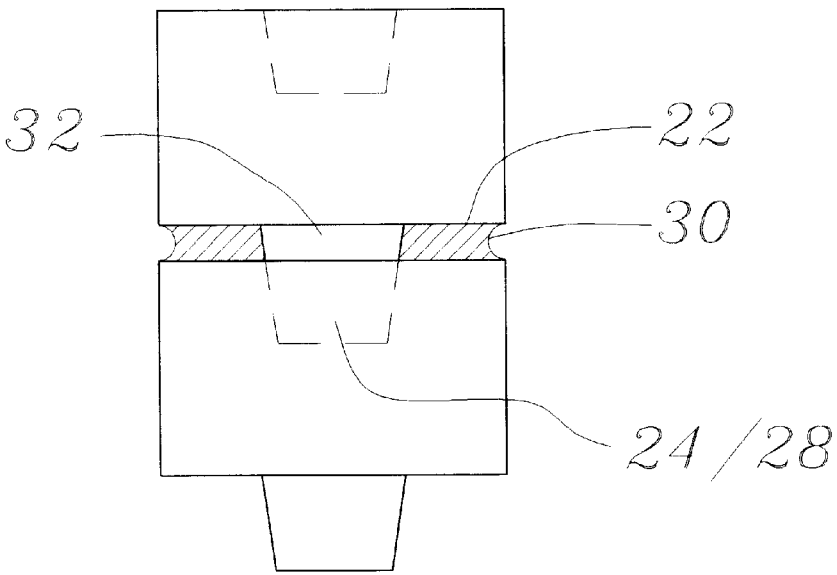
FIG. 7
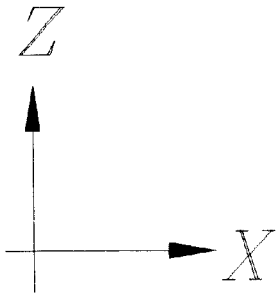

CONSTRUCTIONAL BRICK

REFERENCE TO RELATED APPLICATION

This application corresponds to Provisional Application Serial No. 60/128,789, filed Apr. 12, 1999 and is also a continuation-in-part of application Ser. No. 08/924,517, filed Sep. 5, 1997 now U.S. Pat. No. 6,105,330.

BACKGROUND OF THE INVENTION

1. Field of Invention

The present invention relates to interlocking building bricks for the construction of a building or wall structure.

It is common construction practice to erect building walls, as well as certain categories of free-standing walls, using concrete blocks of a solid rectangular configuration in which each block exhibits a plurality of cavities and external planes at all six sides thereof. Such blocks are, as is well known, laid-up in courses, typically by placing mortar, by trowel, on the top of the blocks and then positioning the blocks of the next course upon the lower course. However, as described below, some systems of interlocking blocks exist which reduce or eliminate the need for such mortar. The instant invention particularly addresses the need for building bricks useful components of an interlocking building brick system capable of resisting high lateral loads of both a uniform and cyclical nature.

2. Description of the Prior Art

The prior art has recognized the need for, and value of, building block systems having interlocking elements at the horizontal interface between courses of building blocks. The rationale for the use of such interlocking between horizontal planes of building blocks has, typically, been to eliminate or minimize the need for mortar between the courses thereof. This, however, is not an object of the present invention.

The inventor is aware of United Kingdom Patent No. 550,745 (1941) to Rigby, which teaches a proportionality of interlock elements, which is completely different from that of the present invention. More particularly, Rigby, as is the case in essentially all prior art known to the inventor, is lacking in the deep key interlock features of the invention, which are set forth herein.

It is further noted that prior art does not address or suggest the need or value of a building block interlock structure between the vertical surfaces of building blocks within courses or rows, apparently because of a lack of recognition of the need for structures that could provide resistance against unusual lateral loads that might be encountered by a wall structure formed of building blocks. However, the extent to which the forces of nature can impact upon the integrity of apparently massive structures, such as building blocks/masonry wall structures, has been long known to architects and structural engineers that have been active in geographical areas prone to high velocity winds and earthquakes. High lateral loads may, as well, result from the horizontal component of truss-type loading upon a wall which is in truss-like communication with roof-beams and other transverse members of a given mechanical system.

The instant invention, accordingly, addresses the long-felt need in the art for a constructional component adapted for use in a wall system capable of resisting such high lateral loads, regardless of the origin thereof.

SUMMARY OF THE INVENTION

The present invention pertains to a constructional brick for use in the forming of a wall structure capable of resisting high gravity and lateral loads of both a uniform and cyclical character. The brick, more particularly, comprises a block having a generally solid rectangular exterior configuration defining an xyz Cartesian coordinate system, an x-axis thereof capable of defining a width axis of the wall structure, a y-axis thereof defining the directionality of the wall structure, and a z-axis thereof defining a vertical axis of the wall structure, in which one xz end surface of each building block comprises a positive y-axis deep key geometry and each opposing xz end surface thereof comprises a negative y-axis deep key geometry complementally interlockable to said positive geometry of said opposite xz surface, in which y-axis deep key dimensions of said respective positive and negative deep key geometries exist in a range of about 10 to about 50 percent of the x-axis dimension of said brick, in which an upper xy surface of said block includes a plurality of z-axis recesses, each having an xy plane lower surface thereof, and a lower xy surface of said brick including a corresponding plurality of integral z-axis male members complementally interlockable with said z-axis recesses. Use of such bricks provides a substantially rigid and load-resistant interlock between horizontally and vertically contiguous bricks, when joined together as components of a wall structure.

It is accordingly an object of the invention to provide a building brick suitable for use as a constructional component of the wall structure adapted for resistance to high lateral loads, both uniform and cyclical.

It is another object to provide a constructional component of a wall system particularly adapted to resist lateral loads resultant from earthquakes, hurricanes, or pre-defined lateral loads within a truss system.

It is a further object of the invention to provide a constructional component providing enhanced resistance to high lateral loads in both the vertical and horizontal planes of interlock between such constructional components.

The above and yet other objects and advantages of the present invention will become apparent from the hereinafter set forth Brief Description of the Drawings, Detailed Description of the Invention.

BRIEF DESCRIPTION OF THE DRAWINGS

FIG. 7 is a cross-sectional view taken along Line 7—7 of FIG. 6 showing the xy plane interface between lower and upper xy surfaces of the present brick.

DETAILED DESCRIPTION OF THE INVENTION

Figure 1:
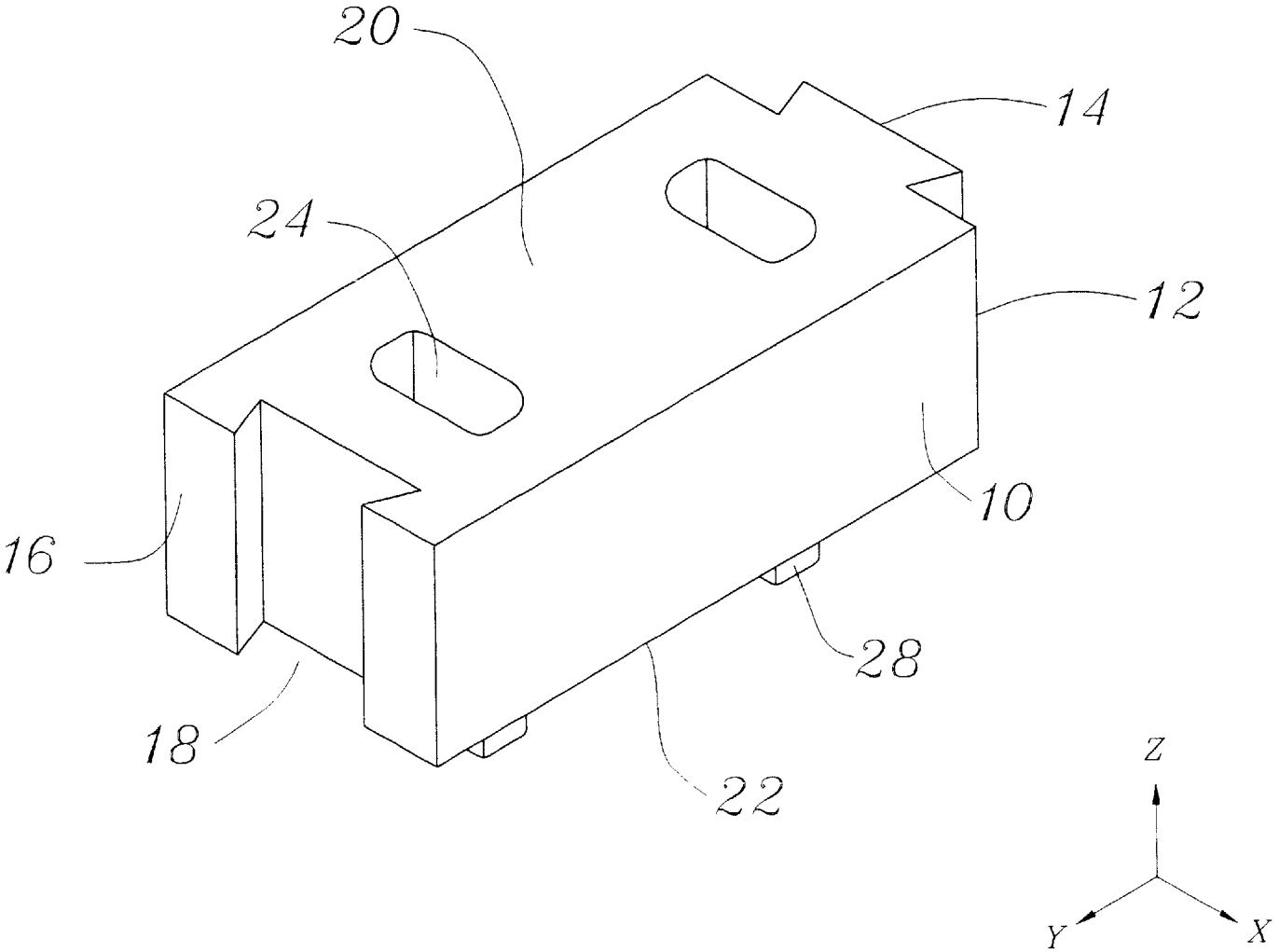
FIG. 1 is an isometric view of the inventive constructional brick.

With reference to FIG. 1 there is shown the instant inventive constructional brick and, therewith, the xyz Cartesian coordinate axis system by which a generally solid rectangular exterior configuration of block 10 may be characterized. Therein the x-axis defines a width axis of a wall structure of the type shown in FIG. 6 that may be formed with block 10. Further, a y-axis thereof defines the directionality of the wall of FIG. 6, while the z-axis thereof defines the vertical axis of a resultant wall structure.

With reference to the geometry of an individual block 10, it may be noted that a first xz end surface 12 includes a positive y-axis deep key geometry 14 which, in a preferred embodiment, exhibits an xy plane cross-section in the nature of a trapezoid.

Further, each opposing xz end surface 16 is provided with a negative y-axis deep key geometry 18 which is complementally interlockable to said positive deep key geometry 14 of opposite surface 12. It should be noted that the y-axis key dimensions of geometries 14 and 18 exhibit a range of about 10 to about 50 percent of the x-axis dimension of the block.

Figure 2:
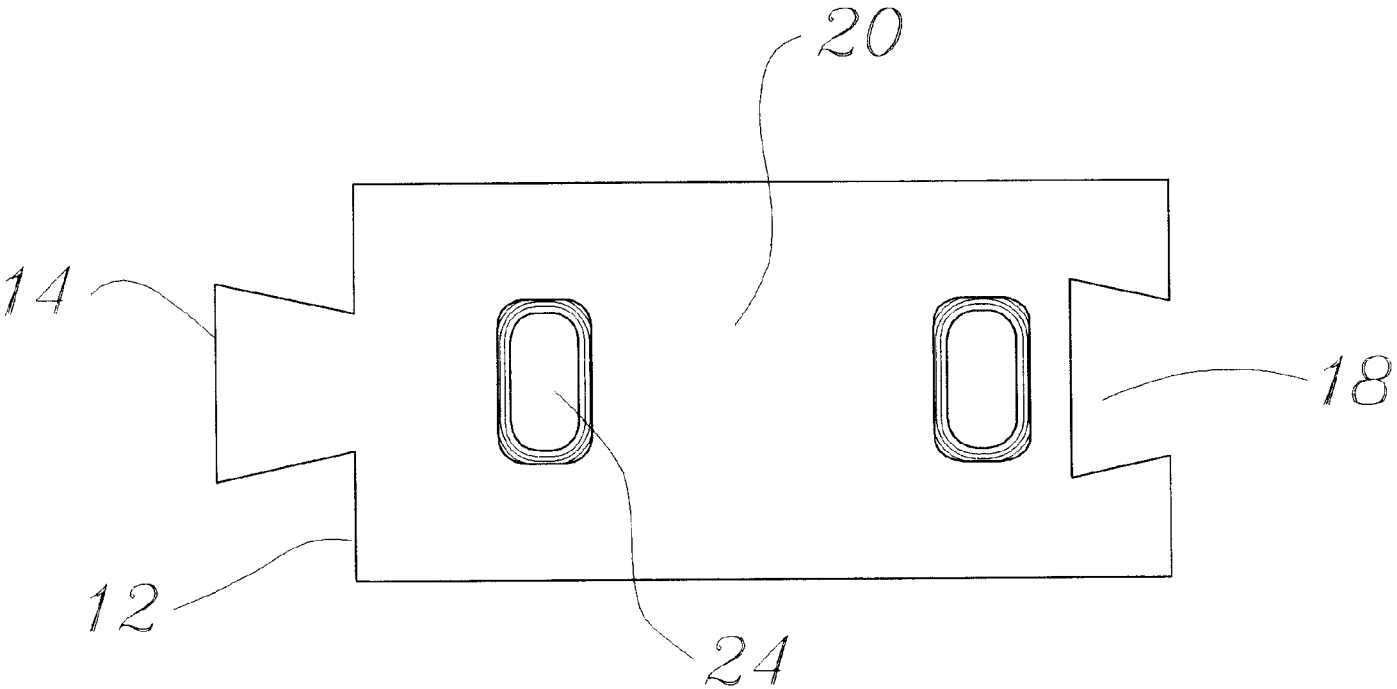
FIG. 2 is a top (xy plane) plan view thereof.
Figure 3:
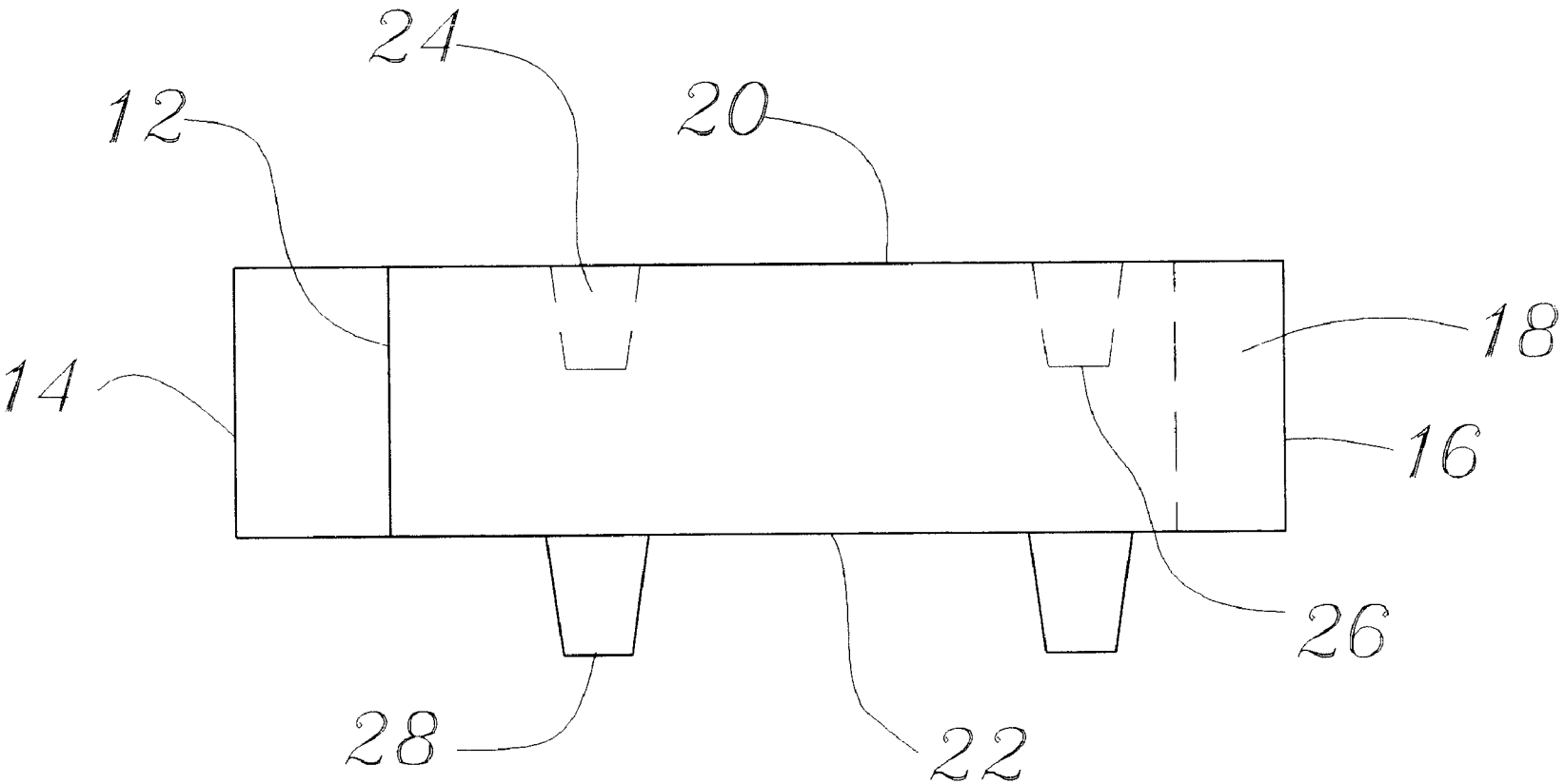
FIG. 3 is a front plan view of the constructional brick of FIG. 1.
Figure 8:
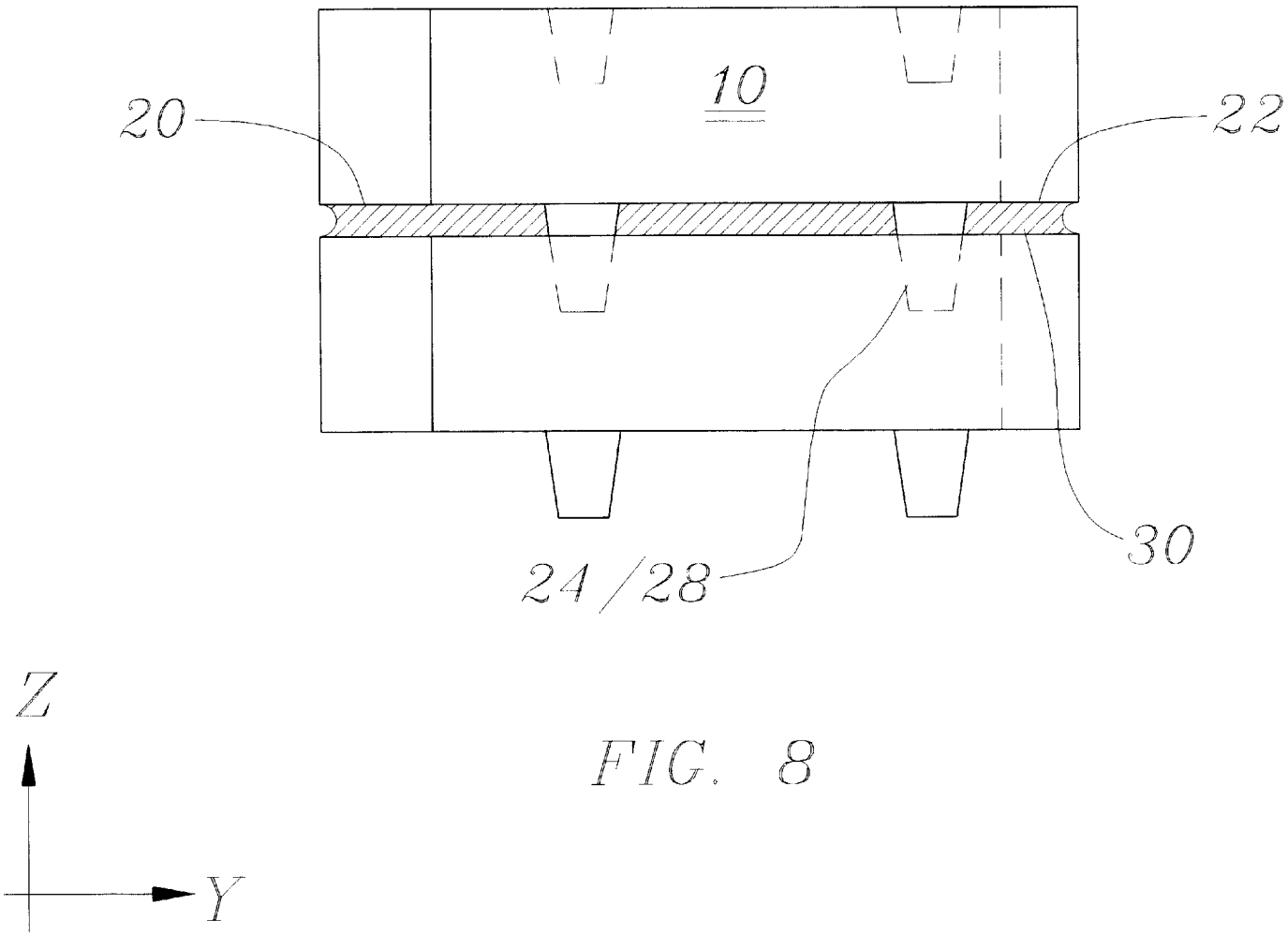
FIG. 8 is a plan view in the yz plane of FIG. 6 after mortar has been applied between the opposing xy surfaces of the constructive brick.
Figure 8A:
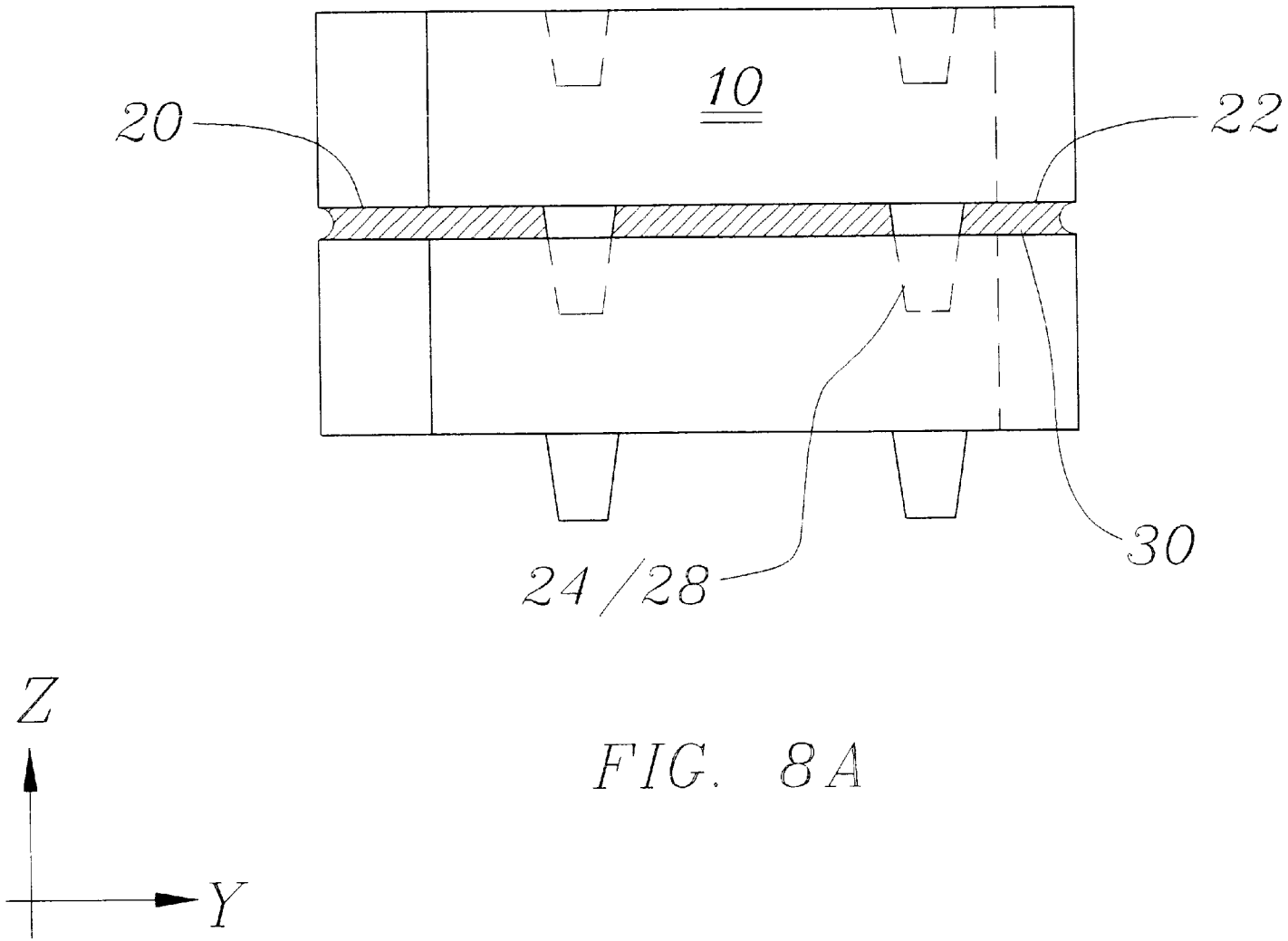
FIG. 8A is a plan view showing a variation of the arrangement of bricks shown in FIG. 8.

The block 10 further exhibits an upper xy surface 20 and a lower xy surface 22 (see also FIGS. 2 and 3). Within each upper xy surface 20 is provided a plurality of z-axis recesses 24, each of which is provided with a xy plane lower surface 26. See FIG. 3. It is further noted that each lower xy surface 22 is provided with a corresponding plurality of integral z-axis male members 28 which are complementally interlockable with said z-axis recesses 24. It is, however, to be noted that the z-axis length of each male member 28 exceeds the z-axis depth of each recess 24. Accordingly, as may be noted in FIGS. 6 and 8, there is provided sufficient offset between successive z-axis courses of blocks 10 in order to insert mortar 30 between successive vertical courses of the constructional bricks 10. It is noted that the members 28 may be formed of constructional plastic or metal and embedded within the lower surface 22 of the block during a casting process.

With reference to FIG. 7 it may be noted that, when viewed in the direction of the y-axis, a base structure 32, may be seen from which male members 28 depend.

Figure 4:
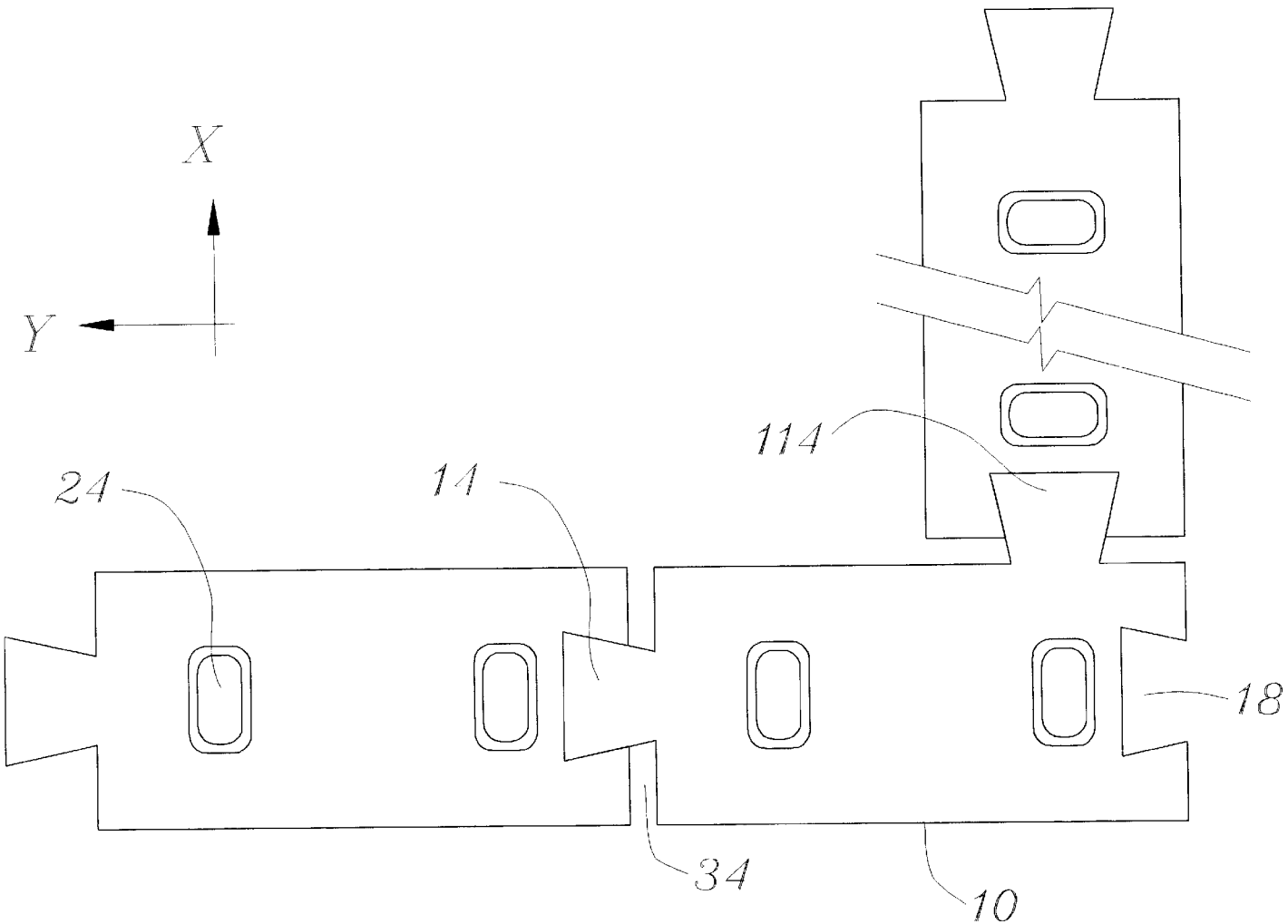
FIG. 4 is a top plan view showing the deep key interlock between contiguous constructional bricks.
Figure 5:
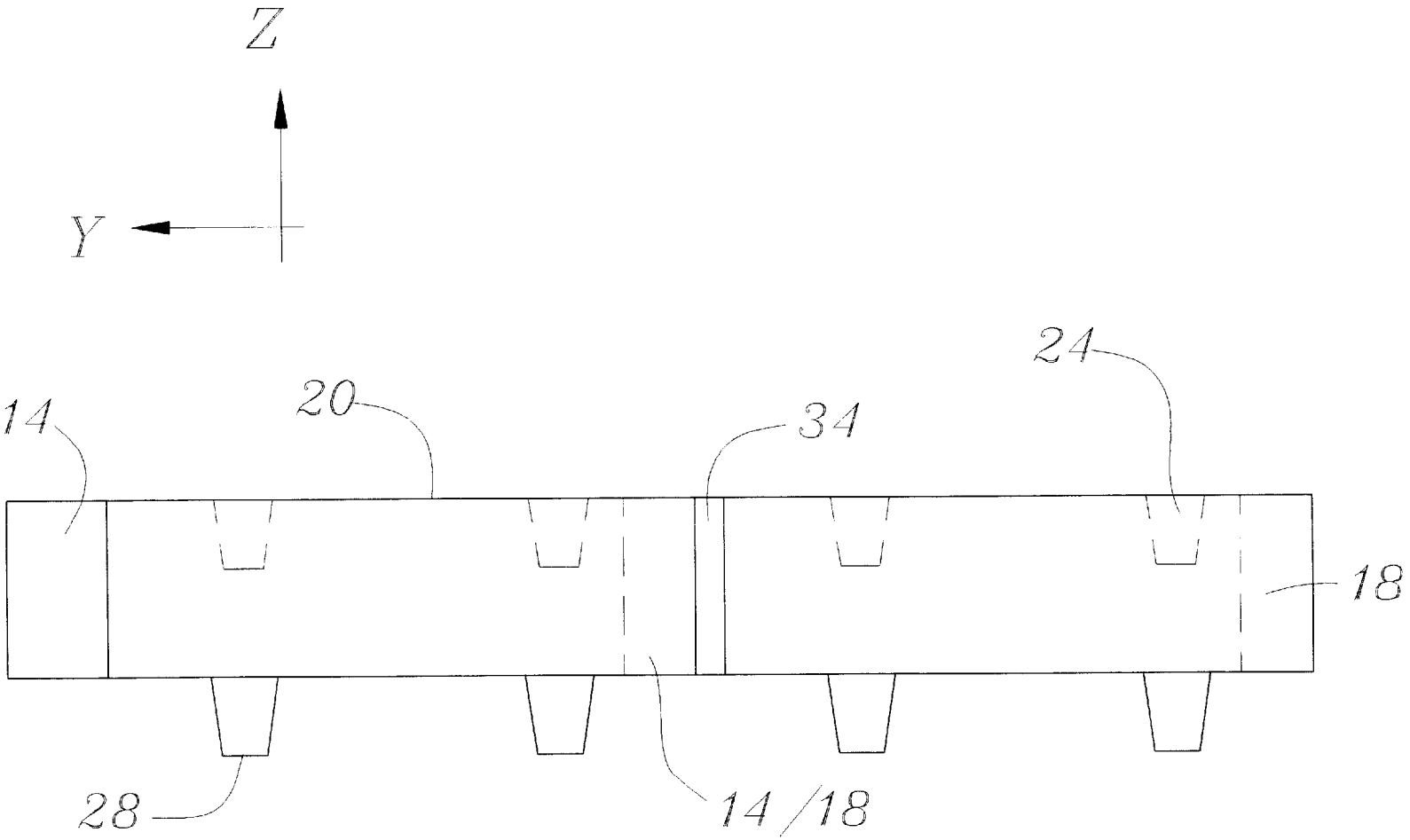
FIG. 5 is a front plan view of FIG. 4.

The nature of the yz axis interlock between positive and negative deep key members 14 and 18 respectively may be appreciated with reference to the views of FIGS. 4 and 5. As may be noted therein, the y-axis length of positive deep key geometry 14 exceeds the y-axis dimension of negative deep key geometry 18. Accordingly, said elements, when complementally interlocked, provide an offset 34 within which motor may be placed.

Further shown in FIG. 4 is the manner in which a right angle may be effected through the placement of a positive deep key geometry 114 upon a yz surface of a block 10. The double annular lines about the recess 24 in FIG. 4 indicate that such recess may be tapered if desired. In such case, the elements 28 must be complementally tapered.

In terms of sample dimensions of a brick made in accordance with the present invention, the x-axis width of a block may be about four inches while the entire y-axis dimension, inclusive of the deep key geometry 14, may be about eight inches. A typical x-axis dimension of recess 24 would be about 1.5 inches. The length of male elements 28 would be 1⅜ inches while the depth of recess 24 would be one inch, thereby providing a ⅜ inch dimension for the insertion of mortar 30. The same ⅜ inch dimension is applicable with respect to offset 34, this representing the difference in y-axis dimension between the positive deep key geometry 14 and the negative deep key geometry 18. It is also noted that each recess 24 exhibits a dimension of 0.75 by 1.5 inches in the xy plane.

A side or yz plan view of FIG. 4 is shown in FIG. 5. Therein may be seen the interlock 14/18 between the positive and negative deep key geometries as well as the mortar offset 34 between respectively horizontally positioned blocks.

Figure 9:
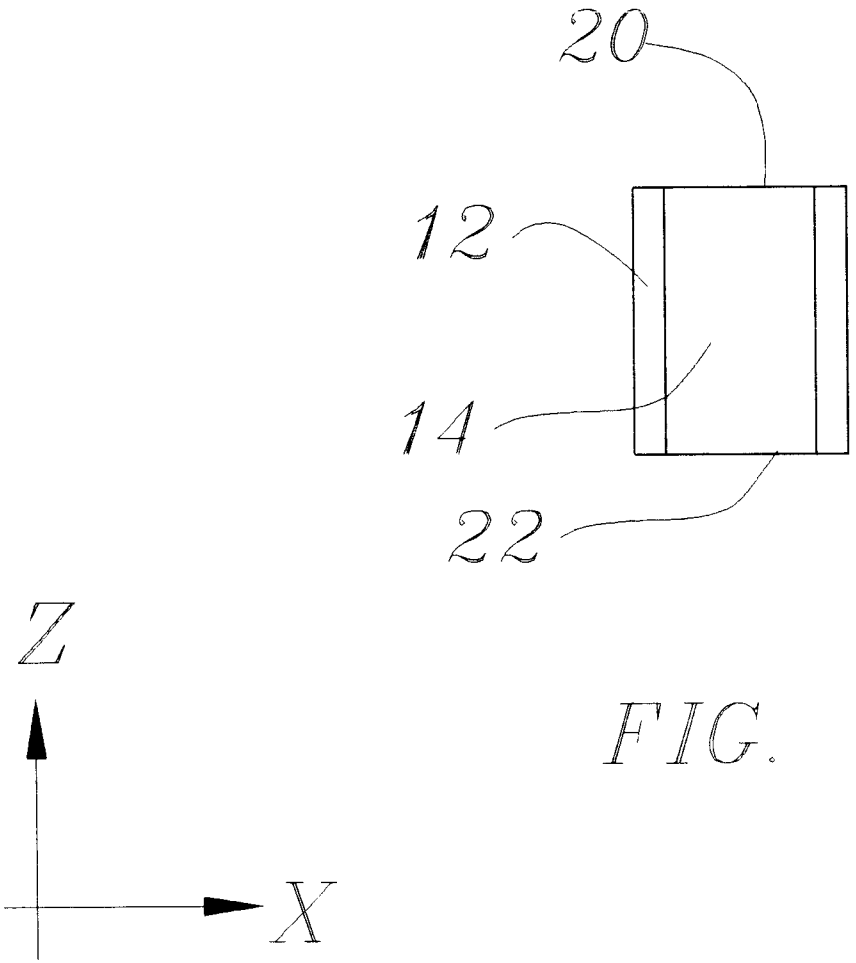
FIG. 9 is a plan left end view of the brick shown in FIG. 1.

FIG. 9 shows the positive deep key geometry 14 in plan yz axis view.

Figure 6:
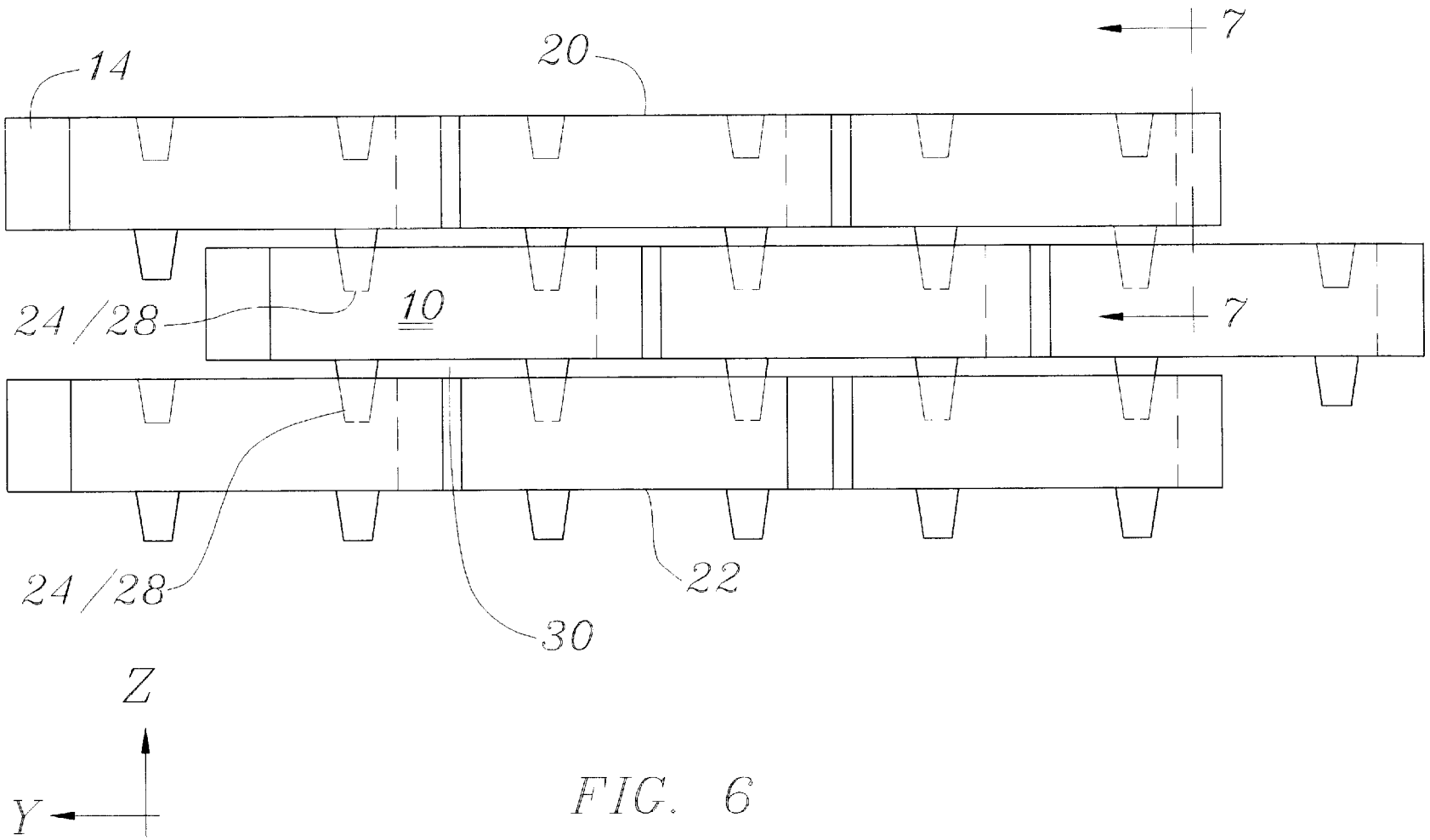
FIG. 6 is a multi-course view showing the vertical positioning of the courses of the present bricks upon each other.

It has been found that a wall structure of the type shown in FIG. 6, resultant from use of the present constructional brick, is capable of resisting high gravity and lateral loads of both a uniform and cyclical nature as, for example, might occur during a wind or snowstorm.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention.

Having thus described my invention what I claim as new, useful and non-obvious and, accordingly, secure by Letters Patent of the United States is:

1. A constructional brick for use in the forming of a wall structure capable of resisting high gravity lateral loads both uniform and cyclical character, the brick comprising:

a block having a generally solid rectangular exterior configuration defining an xyz Cartesian coordinate system, an x-axis thereof capable of defining a width axis of said wall structure, a y-axis thereof defining a length of said wall structure, and a z-axis thereof defining a height of the wall structure, in which one xz end surface of each said block comprises a positive y-axis deep key geometry and each opposing xy end surface thereof comprises a negative y-axis deep key geometry complementally interlockable to said positive geometry of said opposite xz surface, in which a y-axis length of said positive y-axis deep key geometry exceeds a y-axis depth of said negative deep key geometry, thereby providing space for the insertion of mortar between opposing xz brick surfaces in said wall structure, and further in which y-axis deep key dimensions of respective positive and negative deep key geometries comprise a range of about 10% to about 50% of the x-axis dimension of said brick, in which an upper xy surface of said block includes a plurality of z-axis recesses, each having a xy plane lower surface thereof, and a lower xy surface of said brick including a corresponding plurality of integral z-axis male members complementally interlockabale with said z-axis recesses, in which a z-axis length of each of said male members of said lower xy surface exceeds a z-axis depth of said upper xy surface recesses to thereby provide space for insertion of mortar between opposing xy block surfaces in said wall structure, whereby use of such bricks provides a substantially rigid and load-resistant interlock between horizontally and vertically contiguous bricks when joined together as components of a wall structure.

2. The constructional component as recited in claim 1, in which each of said deep key geometries comprise trapezoidal structure.

* * * * *